US005778957A

United States Patent [19]

Torgersen

[11] Patent Number: 5,778,957

[45] Date of Patent: Jul. 14, 1998

[54] PROTECTIVE COVER FOR A MINIBLIND CORD

[76] Inventor: Christine L. Torgersen, 20401 Soledad Cyn Rd. #257, Canyon Country, Calif. 91351

[21] Appl. No.: 821,049

[22] Filed: Mar. 20, 1997

[51] Int. Cl.[6] ..... E06B 9/30

[52] U.S. Cl. ..... 160/178.1 R; 160/173 R; 16/122

[58] Field of Search ..... 160/178 R, 173 R; 16/216, 217, 219, 122

[56] References Cited

U.S. PATENT DOCUMENTS 5,465,775 11/1995 Biba et al. ..... 160/178.1 R X
5,501,262 3/1996 Inaba et al. ..... 160/173 R X
5,513,687 5/1996 Tuzmen et al. ..... 160/178.1 R X
5,553,653 9/1996 Rozon ..... 160/178.1 R X

*Primary Examiner*—Blair Johnson

[57] ABSTRACT

A protective cover for a miniblind cord including an elongated hollow tube having an open upper end and an open lower end. A hook is disposed within the open upper end of the elongated hollow tube. The hook receives a cord threadably therethrough and is passed through the open upper end of the hollow tube and extends outwardly of the open lower end of the hollow tube. An end piece having a vertically oriented aperture directed therethrough receives the cord therethrough whereupon the cord is tied in a knot.

4 Claims, 3 Drawing Sheets

PROTECTIVE COVER FOR A MINIBLIND CORD

BACKGROUND OF THE INVENTION

1. Field of the Invention

The present invention relates to a protective cover for a miniblind cord and more particularly pertains to preventing infants and pets from becoming entangled in the cord with a protective cover for a miniblind cord.

2. Description of the Prior Art

The use of window cord safety devices is known in the prior art. More specifically, window cord safety devices heretofore devised and utilized for the purpose of controlling a vertical blind cord are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,335,776 to Debs discloses a tassel weight.

U.S. Pat. No. 4,813,469 to Scott discloses a louver blind control.

U.S. Pat. No. Des. 329,350 to Jian discloses the ornamental design for a cord lock for a venetian blind lift cord.

U.S. Pat. No. 5,125,447 to Suggs discloses a safety device for window decoration cords.

U.S. Pat. No. 4,635,698 to Anderson discloses a cord equalizer for locking together a plurality of cords of a blind assembly.

U.S. Pat. No. Des. 276,113 to Anderle et al. discloses the ornamental design for a weight for venetian blind cords.

While these devices fulfill their respective, particular objective and requirements, the aforementioned patents do not describe a protective cover for a miniblind cord for preventing infants and pets from becoming entangled in the cord.

In this respect, the protective cover for a miniblind cord according to the present invention substantially departs from the conventional concepts and designs of the prior art, and in doing so provides an apparatus primarily developed for the purpose of preventing infants and pets from becoming entangled in the cord.

Therefore, it can be appreciated that there exists a continuing need for new and improved protective cover for a miniblind cord which can be used for preventing infants and pets from becoming entangled in the cord. In this regard, the present invention substantially fulfills this need.

SUMMARY OF THE INVENTION

In the view of the foregoing disadvantages inherent in the known types of window cord safety devices now present in the prior art, the present invention provides an improved protective cover for a miniblind cord. As such, the general purpose of the present invention, which will be described subsequently in greater detail, is to provide a new and improved protective cover for a miniblind cord and method which has all the advantages of the prior art and none of the disadvantages.

To attain this, the present invention essentially comprises an elongated hollow tube having an open upper end and an open lower end. A planar S-shaped cord hook is disposed within the open upper end of the elongated hollow tube. The S-shaped cord hook is defined by an upper member having a top edge, a bottom edge and opposing side edges. The upper member has a width greater than a diameter of the hollow tube. An upper slot extends inwardly of one of the opposing side edges disposed below the top edge. A lower slot extends inwardly of one of the opposing side edges opposed from the upper slot. The lower slot is disposed above the bottom edge. The bottom edge has an elongated planar member extending downwardly therefrom. The elongated planar member has a width less than the diameter of the hollow tube. The elongated planar member is received within the open upper end of the hollow tube with the bottom edge abutting the open upper end of the hollow tube. The upper slot receives a miniblind cord threadably therethrough with the cord extending downwardly through the lower slot and passed through the open upper end of the hollow tube and extending outwardly of the open lower end of the hollow tube. The device includes an end piece having a frustoconical configuration. The end piece has an upper end having a reduced diameter and a lower end having an enlarged diameter. The diameter of the hollow tube is greater than the upper end of the end piece and less than the lower end of the end piece. The end piece has a vertically oriented aperture directed therethrough. The aperture is dimensioned for receiving the miniblind cord therethrough whereupon the cord is tied in a knot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective cover for a miniblind cord which has all the advantages of the prior art window cord safety devices and none of the disadvantages.

It is another object of the present invention to provide a new and improved protective cover for a miniblind cord which may be easily and efficiently manufactured and marketed.

It is a further object of the present invention to provide a new and improved protective cover for a miniblind cord which is of durable and reliable construction.

An even further object of the present invention is to provide a new and improved protective cover for a miniblind cord which is susceptible of a low cost of manufacture with regard to both materials and labor, and which accordingly is then susceptible of low prices of sale to the consuming public, thereby making such a protective cover for a miniblind cord economically available to the buying public.

Even still another object of the present invention is to provide a new and improved protective cover for a miniblind cord for preventing infants and pets from becoming entangled in the cord.

Lastly, it is an object of the present invention to provide a new and improved protective cover for a miniblind cord including an elongated hollow tube having an open upper end and an open lower end. A hook is disposed within the open upper end of the elongated hollow tube. The hook receives a cord threadably therethrough and is passed through the open upper end of the hollow tube and extends outwardly of the open lower end of the hollow tube. An end piece having a vertically oriented aperture directed therethrough receives the cord therethrough whereupon the cord is tied in a knot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed-drawings wherein.

The same reference numerals refer to the same parts through the various Figures.

DESCRIPTION OF THE PREFERRED EMBODIMENT

Figure 1:
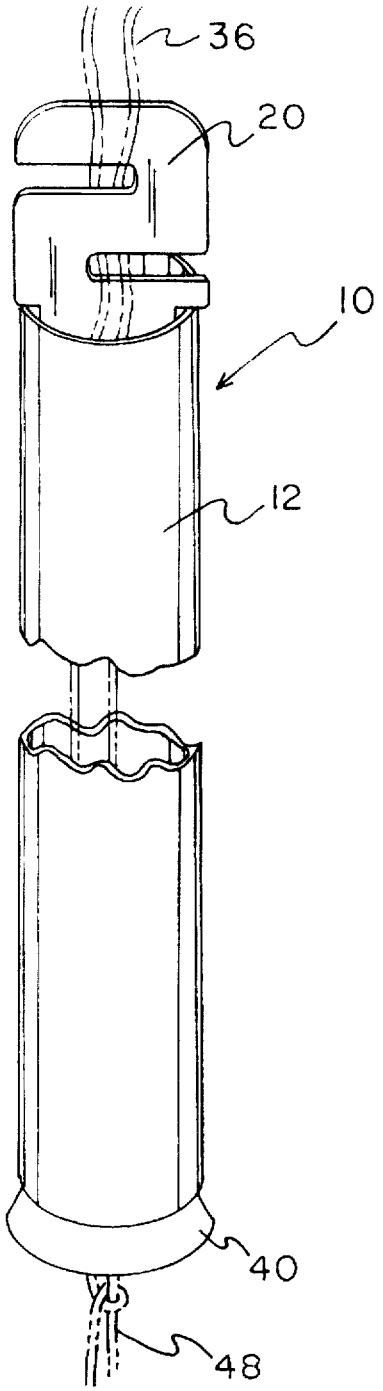
FIG. 1 is a front view of the preferred embodiment of the protective cover for a miniblind cord constructed in accordance with the principles of the present invention.
Figure 2:
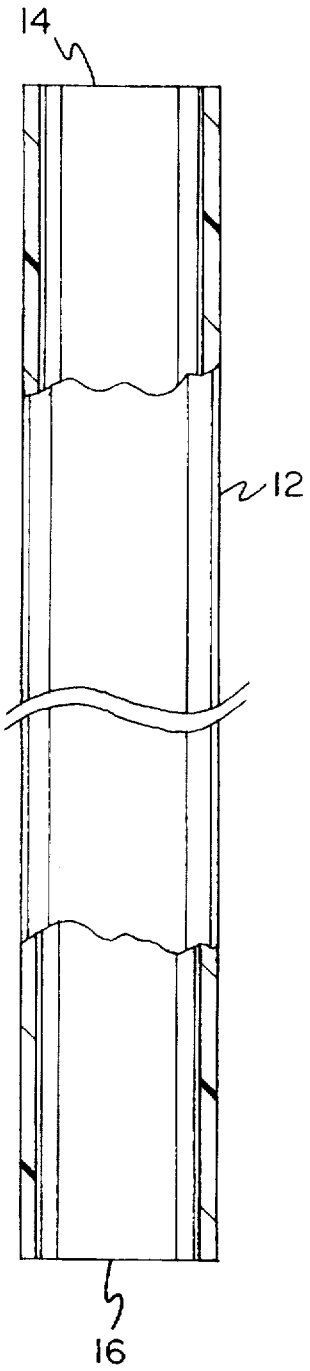
FIG. 2 is a front elevation view of the hollow tube of the present invention illustrated in partial cross-section.
Figure 3:
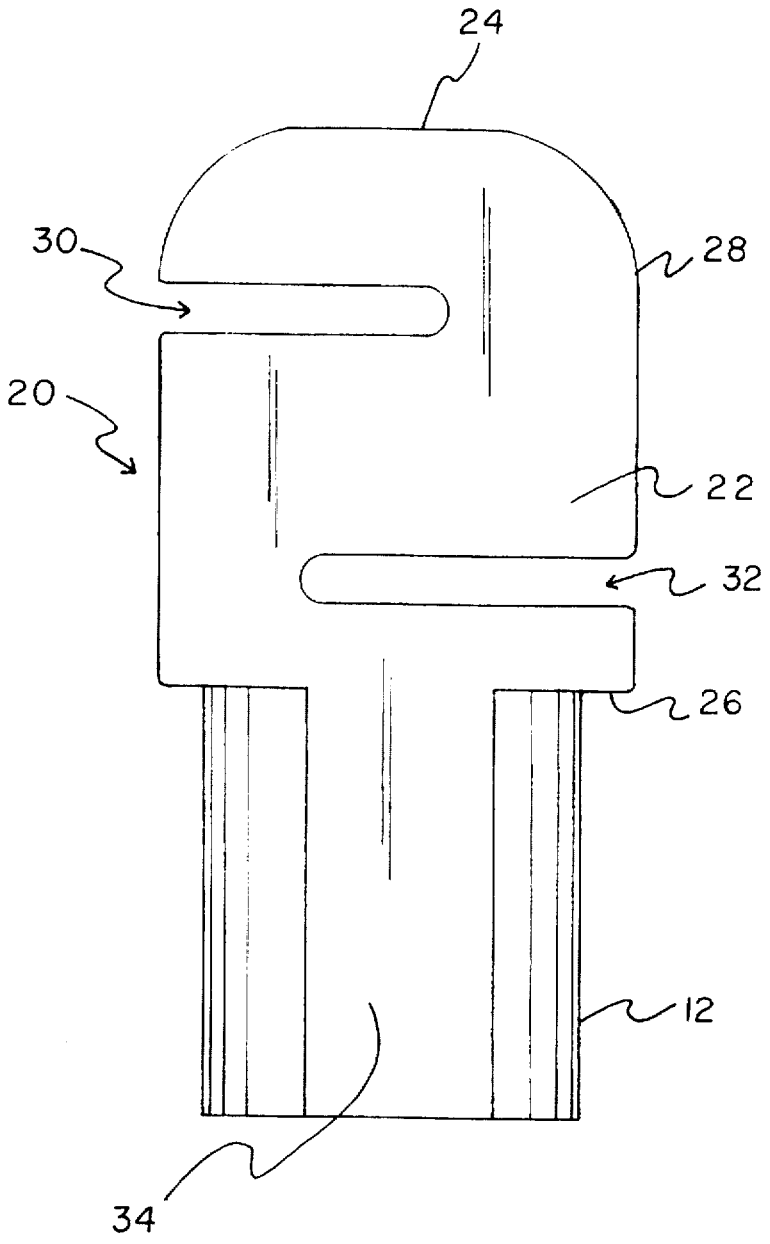
FIG. 3 is a cross-sectional view of the S-shaped cord hook situated within the hollow tube.
Figure 4:
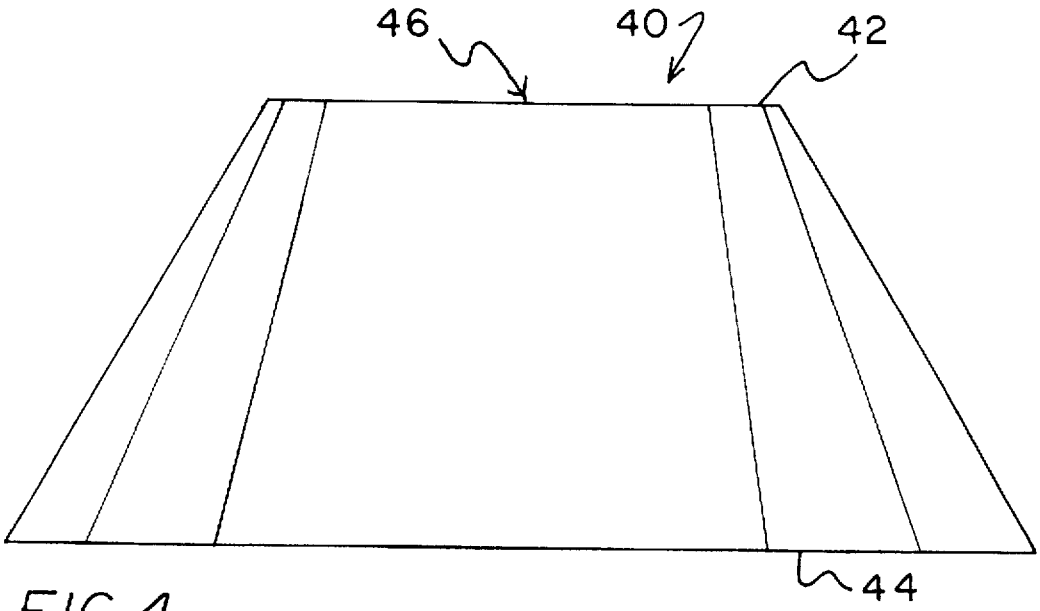
FIG. 4 is a side elevation view of the end piece of the present invention.
Figure 5:
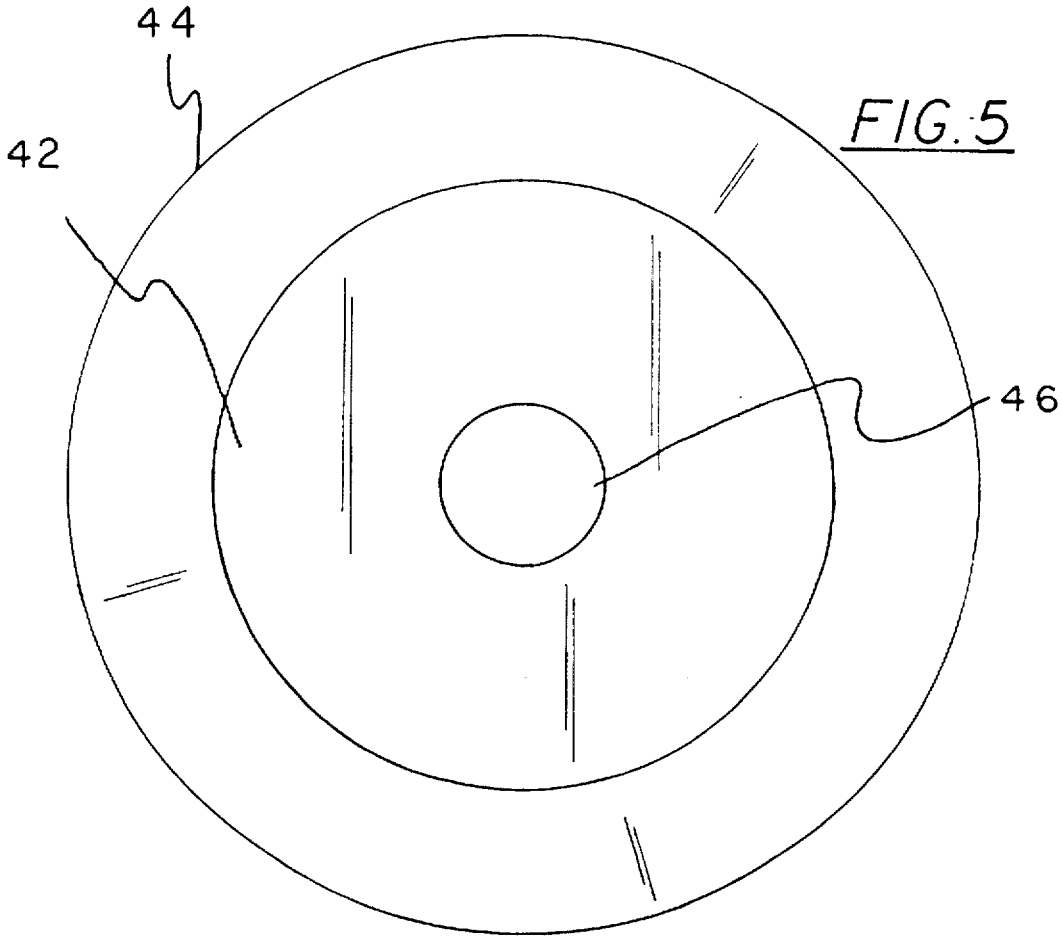
FIG. 5 is a top plan view of the end piece illustrated in FIG. 4.

With reference now to the drawings, and in particular, to FIGS. 1 through 5 thereof, the preferred embodiment of the new and improved protective cover for a miniblind cord embodying the principles and concepts of the present invention and generally designated by the reference number 10 will be described.

Specifically, it will be noted in the various Figures that the device relates to a protective cover for a miniblind cord for preventing infants and pets from becoming entangled in the cord. In its broadest context, the device consists of an elongated hollow tube, an S-shaped cord hook and an end piece. Such components are individually configured and correlated with respect to each other so as to attain the desired objective.

The device 10 includes an elongated hollow tube 12 having an open upper end 14 and an open lower end 16. Note FIGS. 1 and 2. The hollow tube 12 is preferably constructed of a rigid plastic material. The hollow tube 12 could also be made in a clear material or in a color suitable to the decor of the room.

A planar S-shaped cord hook 20 is disposed within the open upper end 14 of the elongated hollow tube 12. The S-shaped cord hook 20 is defined by an upper member 22 having a top edge 24, a bottom edge 26 and opposing side edges 28. The upper member 22 has a width greater than a diameter of the hollow tube 12. Note FIG. 3. An upper slot 30 extends inwardly of one of the opposing side edges 28 disposed below the top edge 24. A lower slot 32 extends inwardly of one of the opposing side edges 28 opposed from the upper slot 30. The lower slot 32 is disposed above the bottom edge 26. The bottom edge 26 has an elongated planar member 34 extending downwardly therefrom. The elongated planar member 34 has a width less than the diameter of the hollow tube 12. The elongated planar member 34 is received within the open upper end 14 of the hollow tube 12 with the bottom edge 26 abutting the open upper end 14 of the hollow tube 12. The upper slot 30 receives a miniblind cord 36 threadably therethrough with the cord 36 extending downwardly through the lower slot 32 and passed through the open upper end 14 of the hollow tube 12 and extends outwardly of the open lower end 16 of the hollow tube 12. Note FIG. 1.

The device 10 includes an end piece 40 having a frusto-conical configuration. Note FIGS. 4 and 5. The end piece 40 has an upper end 42 having a reduced diameter and a lower end 44 having an enlarged diameter. The diameter of the hollow tube 12 is greater than the upper end 42 of the end piece and less than the lower end 44 of the end piece 40. The end piece 40 has a vertically oriented aperture 46 directed therethrough. The aperture 46 is dimensioned for receiving the miniblind cord 36 therethrough whereupon the cord 36 is tied in a knot 48.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A protective cover for a miniblind cord for preventing infants and pets from becoming entangled in the cord comprising, in combination:

an elongated hollow tube having an open upper end and an open lower end;

a planar S-shaped cord hook disposed within the open upper end of the elongated hollow tube, the S-shaped cord hook being defined by an upper member having a top edge, a bottom edge and opposing side edges, the upper member having a width greater than a diameter of the hollow tube, an upper slot extends inwardly of one of the opposing side edges disposed below the top edge, a lower slot extends inwardly of one of the opposing side edges opposed from the upper slot, the lower slot being disposed above the bottom edge, the bottom edge having an elongated planar member extending downwardly therefrom, the elongated planar member having a width less than the diameter of the hollow tube, the elongated planar member received within the open upper end of the hollow tube with the bottom edge abutting the open upper end of the hollow tube, the upper slot receiving a miniblind cord threadably therethrough with the cord extending downwardly through the lower slot and passed through the open upper end of the hollow tube and extending outwardly of the open lower end of the hollow tube; and an end piece having a frustoconical configuration, the end piece having an upper end having a reduced diameter and a lower end having an enlarged diameter, the diameter of the hollow tube being greater than the upper end of the end piece and less than the lower end of the end piece, the end picece having a vertically oriented aperture directed therethrough, the aperture dimensioned for receiving the miniblind cord therethrough whereupon the cord is tied in a knot.

2. A protective cover for a cord comprising:

an elongated hollow tube having an open upper end and an open lower end;

a hook disposed within the open upper end of the elongated hollow tube, the hook receiving a cord threadably therethrough and passed through the open upper end of the hollow tube and extending outwardly of the open lower end of the hollow tube; and an end piece having a vertically oriented aperture directed therethrough, the aperture dimensioned for receiving the cord therethrough whereupon the cord is tied in a knot;

wherein the end piece having a frustoconical configuration, the end piece having an upper end having a reduced diameter and a lower end having an enlarged diameter, the diameter of the hollow tube being greater than the upper end of the end piece and less than the lower end of the end piece.

3. A protective cover for a cord comprising:

an elongated hollow tube having an open upper end and an open lower end;

a hook disposed within the open upper end of the elongated hollow tube, the hook receiving a cord threadably therethrough and passed through the open upper end of the hollow tube and extending outwardly of the open lower end of the hollow tube; and an end piece having a vertically oriented aperture directed therethrough, the aperture dimensioned for receiving the cord therethrough whereupon the cord is tied in a knot;

wherein the hook is a planar generally S-shaped cord hook.

4. The protective cord as set forth in claim 3 wherein the S-shaped cord hook being defined by an upper member having a top edge, a bottom edge and opposing side edges, the upper member having a width greater than a diameter of the hollow tube, an upper slot extends inwardly of one of the opposing side edges disposed below the top edge, a lower slot extends inwardly of one of the opposing side edges opposed from the upper slot, the lower slot being disposed above the bottom edge, the bottom edge having an elongated planar member extending downwardly therefrom, the elongated planar member having a width less than the diameter of the hollow tube, the elongated planar member received within the open upper end of the hollow tube with the bottom edge abutting the open upper end of the hollow tube, the upper slot receiving the cord threadably therethrough with the cord extending downwardly through the lower slot and passed through the open upper end of the hollow tube and extending outwardly of the open lower end of the hollow tube.

* * * * *